US008428502B2

(12) United States Patent
Tokuda et al.

(10) Patent No.: US 8,428,502 B2
(45) Date of Patent: Apr. 23, 2013

(54) BELT-TYPE FIXING DEVICE AND IMAGE FORMING APPARATUS USING SAME

(75) Inventors: Tetsuo Tokuda, Kawasaki (JP); Masaaki Yoshikawa, Tokyo (JP); Akira Shinshi, Machida (JP); Kenichi Hasegawa, Atsugi (JP); Hiroshi Yoshinaga, Ichikawa (JP); Naoki Iwaya, Chofu (JP); Yoshiki Yamaguchi, Sagamihara (JP); Yutaka Ikebuchi, Chigasaki (JP); Shuntaroh Tamaki, Kawasaki (JP); Toshihiko Shimokawa, Zama (JP); Ippei Fujimoto, Ebina (JP); Kenji Ishii, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 342 days.

(21) Appl. No.: 12/923,231

(22) Filed: Sep. 10, 2010

(65) Prior Publication Data

US 2011/0058865 A1 Mar. 10, 2011

(30) Foreign Application Priority Data

Sep. 10, 2009 (JP) ..... 2009-209164

(51) Int. Cl.
*G03G 15/20* (2006.01)

(52) U.S. Cl.
USPC ..... 399/329

(58) Field of Classification Search ..... 399/328, 399/329; 219/216
See application file for complete search history.

(56) References Cited

U.S. PATENT DOCUMENTS

| | | | | |
|---|---|---|---|---|
| 6,476,357 | B2 * | 11/2002 | Ohno et al. | 219/216 |
| 2004/0184848 | A1 | 9/2004 | Oonishi | |
| 2005/0265741 | A1 | 12/2005 | Otsuka | |

FOREIGN PATENT DOCUMENTS

| | | |
|---|---|---|
| CN | 1363861 | 8/2002 |
| CN | 101261481 | 9/2008 |
| JP | 2006-220950 | 8/2006 |
| JP | 2007-171842 | 7/2007 |
| JP | 2007-334205 | 12/2007 |

OTHER PUBLICATIONS

European Office Action dated Mar. 11, 2011.
Chinese Office Action dated May 30, 2012.

* cited by examiner

*Primary Examiner* — William J Royer
(74) *Attorney, Agent, or Firm* — Harness, Dickey & Pierce, P.L.C.

(57) ABSTRACT

A fixing device includes an endless flexible fixing member, a supporting member having a pipe shape disposed inside a loop formed by the fixing member to support the fixing member, a pressing member disposed opposite the supporting member via the fixing member, and a nip formation member disposed opposite the pressing member via the fixing member to form a fixing nip between the fixing member and the pressing member. The fixing member contacts an outer circumferential face of the supporting member at a side opposite a side at which the fixing member contacts the nip formation member at the fixing nip. The fixing member has slack portions formed upstream and downstream from the fixing nip in a conveyance direction of a recording medium. The slack portions extend toward the pressing member over the fixing nip without contacting either the supporting member or the pressing member.

12 Claims, 6 Drawing Sheets

BELT-TYPE FIXING DEVICE AND IMAGE FORMING APPARATUS USING SAME

CROSS-REFERENCE TO RELATED APPLICATIONS

The present patent application claims priority pursuant to 35 U.S.C. §119 from Japanese Patent Application No. 2009-209164, filed on Sep. 10, 2009 in the Japan Patent Office, which is incorporated herein by reference in its entirety.

BACKGROUND OF THE DISCLOSURE

1. Field of the Disclosure

Exemplary embodiments of the present disclosure relate to a fixing device and an image forming apparatus including the fixing device, and more specifically, to a fixing device that applies heat and pressure to a recording medium at a nip formed between a fixing belt and a press member to fix an image on the recording medium, and an image forming apparatus including the fixing device.

2. Description of the Background

Image forming apparatuses include copiers, facsimile machines, printers, or multifunction printers having at least one of copying, printing, scanning, and facsimile capabilities. As one type of image forming apparatus, electrophotographic image forming apparatuses are widely known. In an image formation process executed by an electrophotographic image forming apparatus, for example, a charger uniformly charges a surface of an image carrier (e.g., photoconductor drum); an optical writing unit emits a light beam onto the charged surface of the image carrier to form an electrostatic latent image on the image carrier according to image data; a development device supplies toner to the electrostatic latent image formed on the image carrier to make the electrostatic latent image visible as a toner image; the toner image is directly transferred from the image carrier onto a recording medium or indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device includes, e.g., a rotational fixing unit formed with a roller, a belt, or a combination of a roller and a belt. The fixing device sandwiches a recording medium at a fixing nip and applies heat and pressure to a toner image on the recording medium to fix the toner image on the recording medium.

Several types of fixing devices are conventionally known, including, for example, a belt-type fixing device.

The belt-type fixing device typically includes a pipe-shaped, thermally conductive supporting member (including a heater serving as a heat source, an endless fixing belt heated by the supporting member, and a pressing roller contacting the fixing belt to form a fixing nip between the belt and the pressing roller through which the recording medium bearing the toner image passes. Using the fixing belt and the pressing roller, the belt-type fixing device applies heat and pressure to the recording medium, on which a toner image is transferred, at the fixing nip to fix the toner image on the recording medium.

Continued downsizing of such a belt-type fixing device may reduce the width of the fixing nip, causing lack of heat applied to the recording medium. Hence, a conventional fixing device like that described in JP-2006-220950-A and illustrated in FIG. 1 is proposed that includes a heating member 201, a fixing belt 202, a pressing roller 203, and a belt-guide member 204. The fixing belt 202 rotates with a relatively long diameter set in a conveyance direction of a recording medium P and a relatively short diameter set in a direction perpendicular to the conveyance direction. The pressing roller 203 is positioned in a direction of the short diameter of the fixing belt 202 in contact with the fixing belt 202 to form a fixing nip N through which the recording medium P passes. The belt-guide member 204 contacts an inner surface of the fixing belt 202 to support the fixing belt 202.

In a conventional technique, when the diameter of the fixing belt 202 is shortened to reduce the heat capacity, the width of the fixing nip N may be reduced. Hence, in the conventional fixing device illustrated in FIG. 1, the relatively long diameter of the substantially elliptical shape of the fixing belt 202 is set in the conveyance direction of the recording medium P and the relatively short diameter is set in a vertical direction. With such a configuration, the diameter of the fixing belt 202 is reduced and the width of the fixing nip N is enlarged, thus reducing the warm-up time and enhancing the speed of the fixing device.

However, for the fixing device illustrated in FIG. 1, to form the width of the fixing nip N compatible with the speed-up of the fixing device and obtain a desired pressure at a contact face, an increased thickness of the belt-guide member 204 is needed to reinforce the strength of the belt-guide member 204 for supporting the fixing belt 202 in the substantially elliptical shape. Such an increased thickness of the belt-guide member 204 may result in an increased heat capacity of the contact member contacting the inner circumferential face of the fixing belt 202, increasing the warm-up time required to raise the temperature of the device.

Further, the fixing belt 202, which in its original state has a circular shape, is pressingly deformed into the above-described elliptical shape, and the inner circumferential surface of the fixing belt 202 is held with the belt-guide member 204. Further, the pressing roller 203 is pressed against the fixing belt 202 in the short-diameter direction of the fixing belt 202 to form the fixing nip N, and a portion of the belt-guide member 204 corresponding to the fixing nip N is heated with the heating member 201. Thus, the entire outer circumferential surface of the belt-guide member 204 contacts the inner circumferential surface of the fixing belt 202.

In such a configuration, the temperature of an area of the belt-guide member 204 other than the fixing nip N may decrease, reducing the temperature of the rotating fixing belt 202. Consequently, when the fixing belt 202 returns to the entrance of the fixing nip N, the temperature of the fixing belt 202 may be at its lowest. Consequently, rotating the fixing belt 202 at high speed may cause a fixing failure.

SUMMARY

In at least one exemplary embodiment, there is provided an improved fixing device including an endless, loop-shaped, flexible fixing member, a supporting member, a pressing member, and a nip formation member. The supporting member having a pipe shape is disposed inside a loop formed by the fixing member to support the fixing member. The pressing member is disposed opposite the supporting member via the fixing member. The nip formation member is disposed opposite the pressing member via the fixing member to form a fixing nip between the fixing member and the pressing member. The fixing member is disposed to contact an outer circumferential face of the supporting member at a side opposite a side at which the fixing member contacts the nip formation member at the fixing nip. The fixing member is driven in accordance with rotation of the pressing member to convey a recording medium to the fixing nip. The fixing member has slack portions formed upstream and downstream from the fixing nip in a conveyance direction in which the recording medium is conveyed. The slack portions extend toward the pressing member over the fixing nip without contacting either the supporting member or the pressing member.

In at least one exemplary embodiment, there is provided an improved image forming apparatus including an image forming device to form a toner image on a recording medium and a fixing device to fix the toner image on the recording medium. The fixing device includes an endless, loop-shaped, flexible fixing member, a supporting member, a pressing member, and a nip formation member. The supporting member having a pipe shape is disposed inside a loop formed by the fixing member to support the fixing member. The pressing member is disposed opposite the supporting member via the fixing member. The nip formation member is disposed opposite the pressing member via the fixing member to form a fixing nip between the fixing member and the pressing member. The fixing member is disposed to contact an outer circumferential face of the supporting member at a side opposite a side at which the fixing member contacts the nip formation member at the fixing nip. The fixing member is driven in accordance with rotation of the pressing member to convey a recording medium to the fixing nip. The fixing member has slack portions formed upstream and downstream from the fixing nip in a conveyance direction in which the recording medium is conveyed. The slack portions extend toward the pressing member over the fixing nip without contacting either the supporting member or the pressing member.

BRIEF DESCRIPTION OF THE DRAWINGS

Additional aspects, features, and advantages will be readily ascertained as the same becomes better understood by reference to the following detailed description when considered in connection with the accompanying drawings, wherein.

Figure 1:
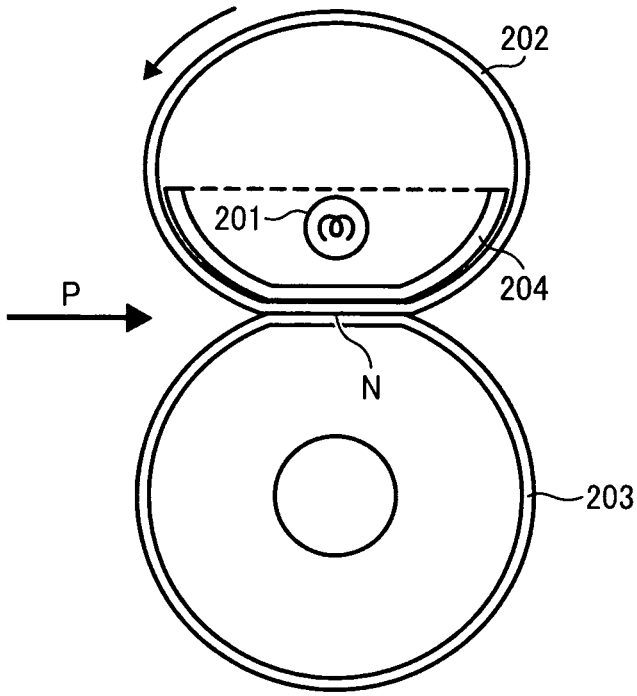
FIG. 1 RELATED ART
FIG. 1 is a schematic view illustrating a configuration of a conventional type of fixing device.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

It is to be noted that, in the description below, reference characters Y, M, C, and K attached to the end of each reference numeral indicate only that components indicated thereby are used for forming yellow, magenta, cyan, and black images, respectively, and hereinafter may be omitted when color discrimination is not necessary.

Figure 2:
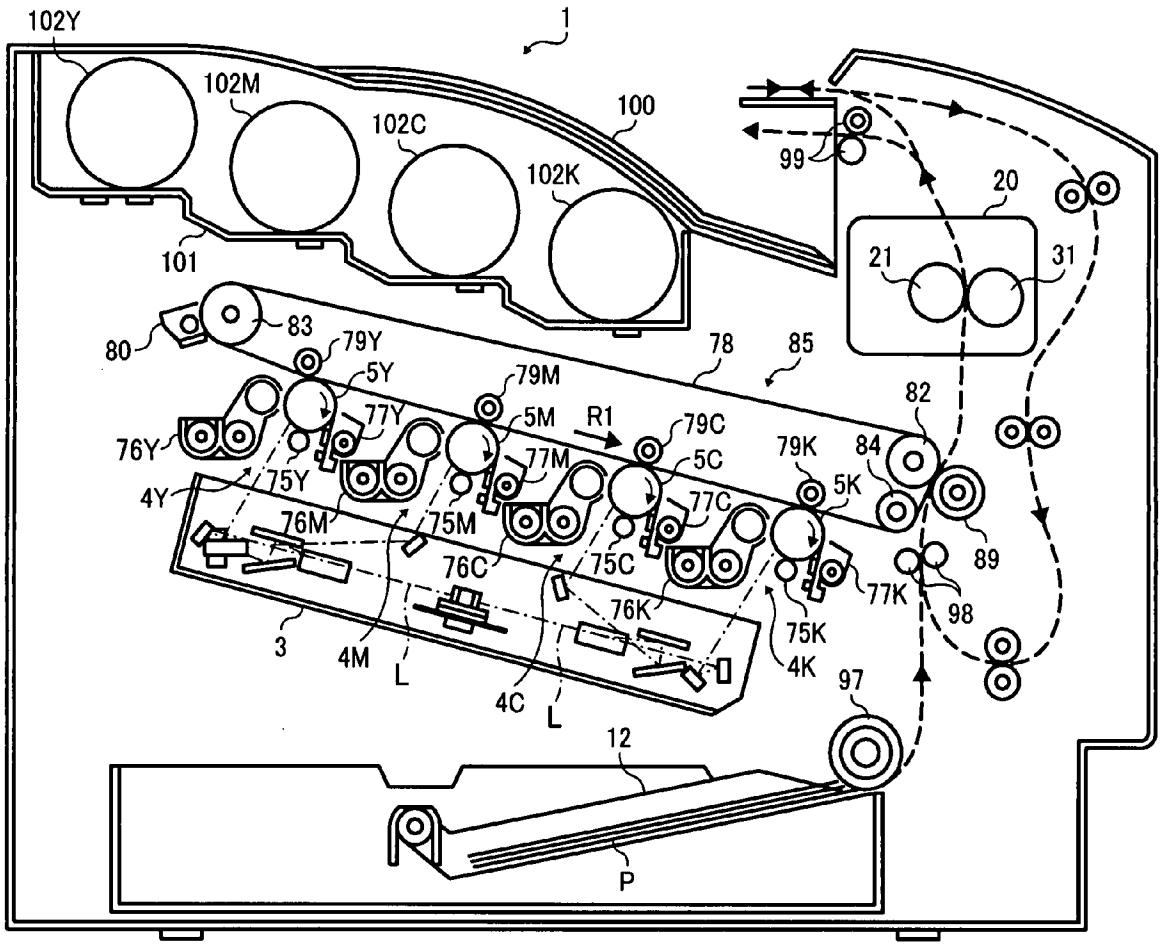
FIG. 2 is a schematic elevation view illustrating a configuration of an image forming apparatus according to an exemplary embodiment of the present disclosure.

Referring now to the drawings, wherein like reference numerals designate identical or corresponding parts throughout the several views, in particular to FIG. 2, an image forming apparatus 1 according to an exemplary embodiment of the present disclosure is explained.

FIG. 2 is a schematic view of the image forming apparatus 1. As illustrated in FIG. 2, the image forming apparatus 1 may be a copier, a facsimile machine, a printer, a multifunction printer having at least one of copying, printing, scanning, plotter, and facsimile capabilities, or the like. According to this exemplary embodiment of the present disclosure, the image forming apparatus 1 is a tandem color printer for forming a color image on a recording medium P.

As illustrated in FIG. 2, the image forming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K. The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 2. In the charging process, the chargers 75Y, 75M, 75C, and 75K are disposed opposite the photoconductive drums 5Y, 5M, 5C, and 5K, respectively, and uniformly charge surfaces of the photoconductive drums 5Y, 5M, 5C, and 5K.

In the exposure process, the exposure device 3 emits laser beams L onto the charged surfaces of the photoconductive drums 5Y, 5M, 5C, and 5K to expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K. The pressing roller 31 is rotated in a direction indicated by an arrow R3 in FIG. 3 (and FIG. 6) by a driving force transmitted from a driving source, such as a motor, disposed in the image forming apparatus via gears.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78 at the first transfer nips formed between the photoconductive drums 5Y, 5M, 5C, and 5K and the intermediate transfer belt 78. Thus, a color toner image is formed on the intermediate transfer belt 78.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process. After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

In this regard, the recording medium P is fed from the paper tray 12 to the second transfer nipping position via the feed roller 97 and the registration roller pair 98.

The paper tray 12 is provided in a lower portion of the image forming apparatus 1, and loads a plurality of recording media P (e.g., transfer sheets).

The feed roller 97 rotates counterclockwise in FIG. 2 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily.

The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

Thus, the color toner image is transferred on the recording medium P.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 3:
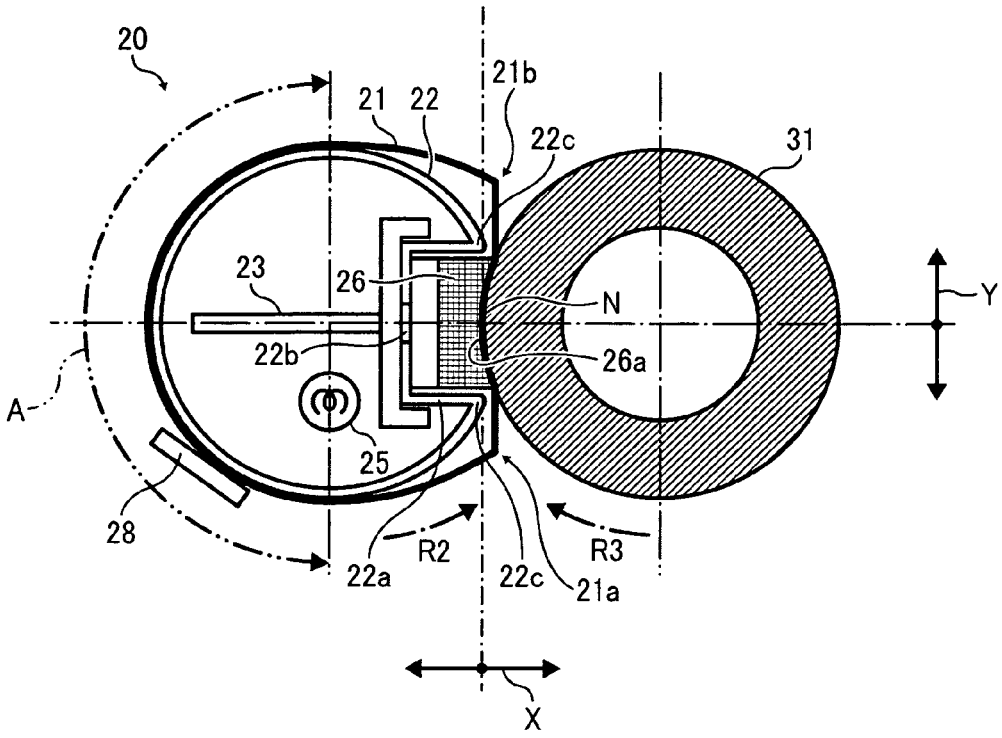
FIG. 3 is a cross-sectional elevation view illustrating a portion of a fixing device according to an exemplary embodiment of the present disclosure.

FIG. 3 is a cross-sectional elevation view illustrating the fixing device 20 according to an exemplary embodiment of the present disclosure.

In FIG. 3, the fixing device 20 includes the fixing belt 21, a supporting member 22, a reinforcement member 23, a halogen heater 25, a thermistor 28, and a pressing roller 31. The fixing belt 21 is an endless belt member serving as a fixing member that forms a loop. The supporting member 22 has a pipe shape and is disposed inside the loop formed by the fixing belt 21 to conduct heat to the fixing belt 21 and support the fixing belt 21 as a support member. The halogen heater 25 is a heating member, and the thermistor 28 is a temperature sensor to detect a surface temperature of the fixing belt 21 in contact with the fixing belt 21. The pressing roller 31 is a pressing member disposed in contact with the fixing belt 21 to form a fixing nip N.

The supporting member 22 includes a recessed portion 22*a* opposite the fixing nip N. At the recessed portion 22*a* are disposed a nip formation member 26 and a heat insulator 27. The heat insulator 27 is disposed between the nip formation member 26 and a bottom of the recessed portion 22*a* (see FIG. 6).

The nip formation member 26 is formed of an elastic material, such as silicone rubber or fluorocarbon rubber, and indirectly slides against an inner surface of the fixing belt 21 via a sliding sheet. Alternatively, the nip formation member 26 may directly slide against the inner surface of the fixing belt 21.

The recessed portion 22*a* of the supporting member 22 is not limited to the recessed shape and may be a flat shape or any other suitable shape. However, with the recessed shape, the discharge direction of the front tip of the recording medium P is close to the pressing roller 31. Such a configuration allows the recording medium P to more easily separate from the fixing belt 21, preventing sheet jam.

The pressing roller 31 includes a hollow metal roller having a silicone rubber layer. A releasing layer, such as a perfluoroalkoxy (PFA) resin layer or a polytetrafluoroethylene (PTFE) resin layer, is formed on an outer surface of the pressing roller 31 to obtain good releasing property.

The pressing roller 31 is rotated by a driving force transmitted from a driving source, such as a motor, disposed in the image forming apparatus 1 via gears. Further, the pressing roller 31 is pressed against the fixing belt 21 by a spring or other member. As a result, the rubber layer of the pressing roller 31 is squashed and deformed to form a certain width of the fixing nip N.

It is to be noted that the pressing roller 31 may be formed of a solid roller. However, a hollow roller is preferable in that the heat capacity is relatively small. The pressing roller 31 may include a heat source such as a halogen heater.

The silicone rubber layer of the pressing roller 31 may be solid rubber. Alternatively, if a heat source, such as a heater, is not provided in the pressing roller 31, the silicone rubber layer may be made of sponge rubber. Sponge rubber is preferable in that the insulation performance is relatively high and thus less of the heat of the fixing belt 21 is transmitted to the pressing roller 31.

The fixing belt 21 is a thin, flexible endless belt that circulates (travels) counterclockwise in FIG. 3. The fixing belt 21 includes a substrate, an intermediate elastic layer, and a surface releasing member, layered in this order one on another, and has a total thickness of equal to or less than 1 mm.

The substrate of the fixing belt 21 has a thickness of approximately 25 to 50 μm and is made of a metal material, such as nickel or stainless steel, a resin material, or any other suitable material.

The elastic layer of the fixing belt 21 has a thickness of approximately 100 to 300 μm and is made of rubber material, such as silicone rubber, foamed silicone rubber, or fluorocarbon rubber. Forming the elastic layer prevents minute irregularities from being formed on the surface of the fixing belt 21 at the fixing nip N. Thus, heat can be uniformly transmitted over a toner image on the recording medium P, preventing formation of a dented image.

The releasing layer of the fixing belt 21 has a thickness of approximately 10 to 50 μm, and is made of a resin material, such as tetrafluoroethylene perfluoro alkyl vinyl ether copolymer (PFA) resin, polytetrafluoroethylene (PTFE) resin, polyimide resin, polyetherimide resin, or polyethersulfone (PES) resin. Forming the releasing layer also secures an excellent releasing (separation) performance from toner (a toner image).

The diameter of the fixing belt 21 is set to approximately 15 to 120 mm. In this exemplary embodiment, the diameter of the fixing belt 21 is set to 30 mm.

The inner face of the fixing belt 21 is backed up with the reinforcement member 23. The fixing belt 21 is pressed between the nip formation member 26 and the pressing roller 31 directly or via the sliding sheet. Thus, the fixing nip N is formed between the fixing belt 21 and the pressing roller 31. The pressing roller 31 is driven by the driving source to rotate together with the fixing belt 21.

A contact portion of the fixing belt 21 contacting the pressing roller 31 at the nip formation member 26 has a curvature corresponding to a curvature of a circular cross section of the pressing roller 31. The curvature radius of the nip formation member 26 is set in a range from approximately 25 to 60 mm.

As described above, the curvature radius of the fixing-nip N is set in a range from approximately 25 to 60 mm along the curvature of the pressing roller 31, and the inner circumferential face of the fixing belt 21 is pressed against the pressing roller 31 with the nip formation member 26 having the recessed shape. Thus, the fixing belt 21 holds its shape along the recessed shape of the nip formation member 26 upstream and downstream in a direction in which the recording medium P is conveyed at the fixing-nip N.

As described above, the supporting member 22 has a semi-cylindrical shape in which a portion of the supporting member 22 (corresponding to the recessed portion 22*a*) close to the fixing nip N has a variant form. The fixing belt 21 is heated by contacting a heating contact portion A of the supporting member 22 that is a circumferential side portion of the supporting member 22 opposite the fixing-nip N. When the fixing belt 21 is driven to rotate, as illustrated in FIG. 3, in cross-section the fixing belt 21 is deformed into substantially a half-moon shape. During rotation, the fixing belt 21 is deformed to have slack 21*a* and 21*b* in which respective portions of the fixing belt 21 upstream and downstream the fixing-nip N in a conveyance direction Y of the recording medium P are expanded to a position closer to the pressing roller 31 than the fixing-nip N in a horizontal direction X without contacting the supporting member 22 and the pressing roller 31.

As described above, in this exemplary embodiment, the substrate of the fixing belt 21 is made of stainless steel or nickel and has a thickness of approximately 25 to 50 μm to have a certain level of hardness. With such a configuration, when the pressing roller 31 is driven to rotate together with the fixing belt 21, the fixing belt 21 floats in the air upstream and downstream of the fixing nip N without contacting the supporting member 22 and the pressing roller 31 to form, within a certain range, slack areas bent closer to the pressing roller 31 than the fixing nip N with respect to the horizontal direction. The slack 21*a* upstream of the fixing nip N is also referred to as a pre-fixing nip and the slack 21*b* is also referred to as a post-fixing nip.

According to the present exemplary embodiment, the heating time of the recording medium P at the slack upstream of the fixing-nip N, that is, the pre-fixing nip 21*a* before the recording medium P enters the fixing-nip N can be adjusted within a proper range, and the supplementary heating time of the recording medium P at the slack downstream of the fixing-nip N, that is, the post-fixing nip 21*b* can be adjusted within a proper range. Such a configuration can prevent heat shortage at high-speed rotation during the fixing process, regulate the post-fixing nip in a range in which high-temperature offset due to overheating does not occur, and provide enhanced fixing performance even with a relatively narrow, small nipping width.

More specifically, at the portions upstream and downstream from the fixing-nip N in the conveyance direction Y of the recording medium P, the fixing belt 21 is slacked toward the recording medium P over a fixing-nip line to approach the recording medium P. Such a configuration can increase the temperature of the recording medium P without applying pressure to the upstream expanded portion (pre-fixing nip 21*a*) and applies heat to the downstream expanding portion (post-fixing nip 21*b*) without applying pressure to the downstream expanding portion. Accordingly, instead of upsizing the fixing belt 21 or the pressing roller 31, increasing a contact area between the recording medium P and the fixing belt 21 allows reduction of a first print time taken from a heating standby state without increasing the heat capacity of the pressing roller 31. Further, heat shortage at high-speed rotation can be prevented, thus providing enhanced fixing performance even with a relatively narrow, small nipping width.

At this time, the reinforcement member 23 and other members in the supporting member 22 might be heated by, e.g., radiation heat of the halogen heater 25. In such a case, the surfaces of those members may be insulated or mirror-finished to prevent heating. Such a configuration can prevent wasteful heat energy consumption. It is to be noted that the heat source to heat the supporting member 22 is not limited to the halogen heater 25 as illustrated in FIG. 3 and may be, e.g., an induction heater. Further, a resistance heater or a carbon heater may be employed.

Figure 4:
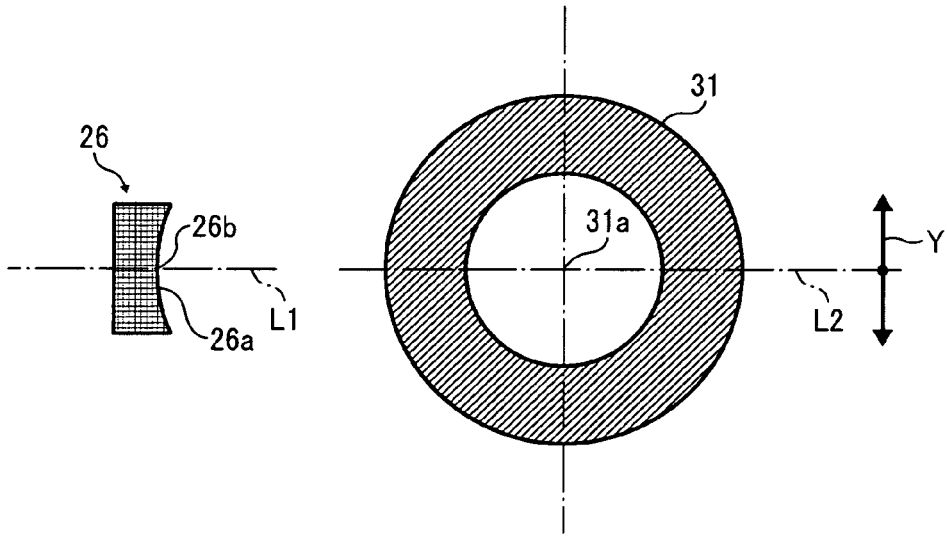
FIG. 4 is a schematic view illustrating relative positions of a nip formation member and a pressing roller.

FIG. 4 is a schematic view illustrating relative positions of the nip formation member 26 and the pressing roller 31 the present exemplary embodiment.

As illustrated in FIG. 4, a center line L1 passing a curvature center 26*b* of the recessed portion 26*a* having a curvature radius of approximately 25 to 60 mm along the curvature of the pressing roller 31 is disposed at substantially the same position in a substantially vertical direction as a central line L2 passing a center 31*a* of the pressing roller 31. Thus, upstream and downstream of the fixing-nip N, the fixing belt 21 is deformed to have slack therein (the pre-fixing nip 21*a* and post-fixing nip 21*b*) of substantially the same shape closer to the pressing roller 31 than the fixing-nip N in the horizontal direction without contacting the pressing roller 31.

As noted previously, the substrate of the fixing belt 21 has a thickness of approximately 25 to 50 μm and is made of a metal material, such as nickel or stainless steel, to obtain a high hardness. For such a configuration, when the fixing belt 21 is rotated in accordance with rotation of the pressing roller 31, the fixing belt 21 is rotatably supported by the heating contact portion A of the supporting member 22 in a substantially uniform way, allowing the shapes of the pre-fixing nip 21*a* and post-fixing nip 21*b* to be stably maintained.

Figure 5A:
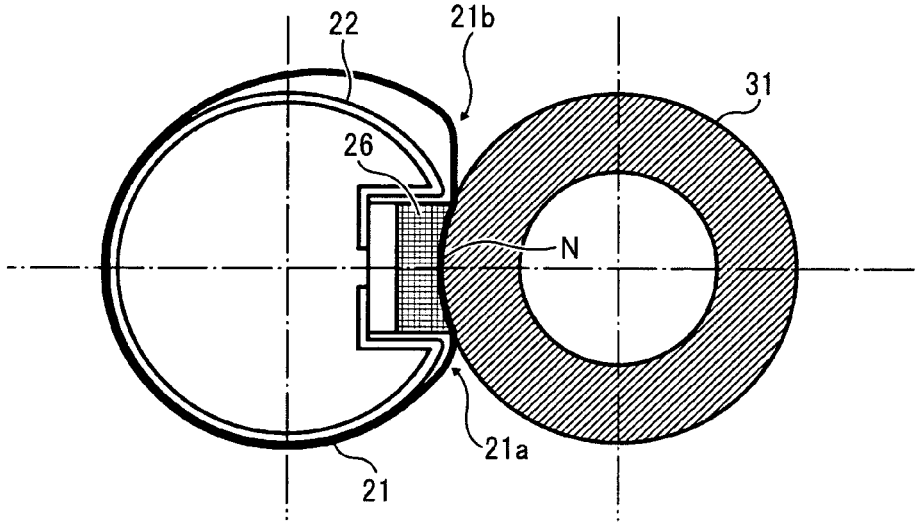
FIG. 5A is a schematic view illustrating a relation between thickness of a substrate of a fixing belt and shapes of a pre-fixing nip and a post-fixing nip.
Figure 5B:
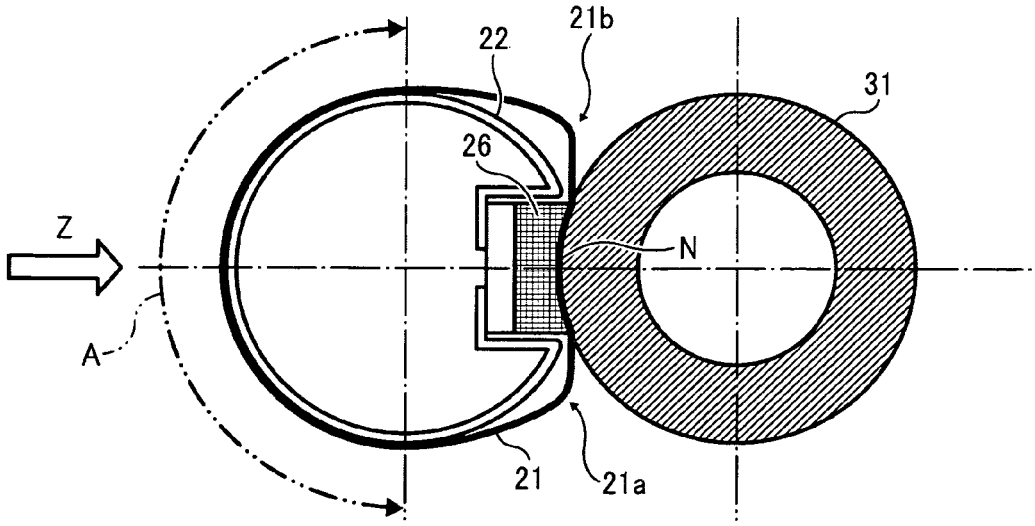
FIG. 5B is a schematic view illustrating another relation between thickness of a substrate of a fixing belt and shapes of a pre-fixing nip and a post-fixing nip.

Next, with reference to FIGS. 5A and 5B, a description is given of an experiment testing the relation between the thickness of the substrate of the fixing belt 21 and the shapes of the pre-fixing nip 21*a* and post-fixing nip 21*b* in the fixing device 20 according to the present exemplary embodiment.

As illustrated in FIG. 5A, if the thickness of the substrate of the fixing belt 21 is less than 25 μm, the pre-fixing nip 21*a* may not be maintained due to lack of rigidity of the fixing belt 21. Consequently, upstream of the fixing nip N, the fixing belt 21 travels along the supporting member 22, thus enlarging the post-fixing nip 21*b* downstream of the fixing nip N. Accordingly, the time in which the recording medium P contacts the post-fixing nip 21*b* may become too long, causing a failure such as high-temperature offset or wrapping of the recording medium P around the fixing belt 21.

Alternatively, as illustrated in FIG. 5B, if the thickness of the substrate of the fixing belt 21 is greater than 50 μm, the pre-fixing nip 21*a* and the post-fixing nip 21*b* can be maintained in substantially the same shape. However, a contact force of the supporting member 22 against the heating contact portion A in a direction indicated by an arrow Z in FIG. 5B may increase, causing an increased resistance force against the rotation of the fixing belt 21. Consequently, the fixing drive torque of the pressing roller 31 may increase, or slippage of the fixing belt 21 or deformation of the supporting member 22 may occur.

In the present exemplary embodiment, as described above, the heating time of a recording medium P at the pre-fixing nip 21*a* before the recording medium P enters the fixing-nip N is set appropriately, and the supplemental heating time of the recording medium P at the post-fixing nip 21*b* is set appropriately. Such a configuration can prevent heat shortage at high-speed rotation in the fixing process and keep the size of the post-fixing nip 21*b* within a range in which high-temperature offset does not occur, providing enhanced fixing performance even with a relatively small nipping width.

Figure 6:
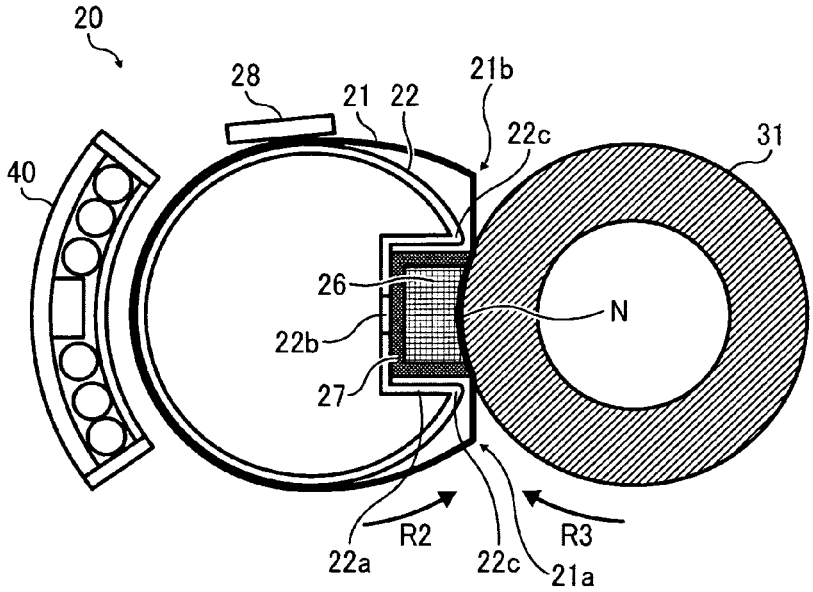
FIG. 6 is a cross-sectional view illustrating a configuration of an induction heater used in the fixing device.

As illustrated in FIG. 6, the fixing device 20 may include an induction heater 40 instead of the heater 25 (e.g., a halogen heater or a carbon heater) illustrated in FIG. 3. The induction heater 40 may be disposed outside the loop formed by the fixing belt 21 to face the outer circumferential surface of the fixing belt 21, and serves as a heater for heating the fixing belt 21 by using electromagnetic induction of induction heating (1H).

The induction heater 40 includes an exciting coil, a core, and a coil guide. The exciting coil includes litz wires formed of bundled thin wires and extended in the width direction of the fixing belt 21 to cover a part of the fixing belt 21. The coil guide includes heat-resistant resin and holds the exciting coil and the core. The core is a semi-cylindrical member formed of a ferromagnet (e.g., ferrite) having relative magnetic permeability in a range of from approximately 1,000 to approximately 3,000. The core includes a center core and a side core to effectively generate magnetic fluxes toward the supporting member 22. The core is disposed opposite the exciting coil extending in the width direction of the fixing belt 21.

The following describes operation of the fixing device 20 including the induction heater 40 having the above-described structure.

When the fixing belt 21 rotates in the direction indicated by an arrow R2 illustrated in FIG. 6, the induction heater 40 heats the fixing belt 21 at a position at which the induction heater 40 faces the fixing belt 21. Specifically, a high-frequency alternating current is applied to the exciting coil to generate magnetic lines of force around the supporting member 22 in such a manner that the magnetic lines of force are alternately switched back and forth. Accordingly, an eddy current is generated on a surface of the supporting member 22, and electrical resistance of the supporting member 22 generates Joule heat. The Joule heat heats the supporting member 22 by electromagnetic induction, and the supporting member 22 heated heats the fixing belt 21.

In order to effectively heat the supporting member 22 by electromagnetic induction, the induction heater 40 may face the supporting member 22 over an entire circumferential direction of the supporting member 22. The supporting member 22 may include nickel, stainless steel, iron, copper, cobalt, chrome, aluminum, gold, platinum, silver, tin, palladium, and/or an alloy of a plurality of those metals, or the like.

Figure 7:
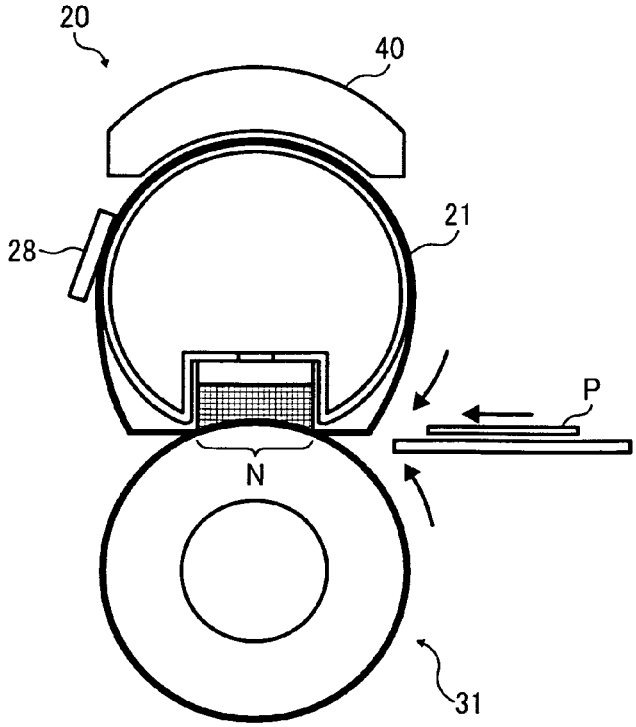
FIG. 7 is a cross-sectional view illustrating another configuration of the induction heater used in the fixing device.

In the fixing device 20 illustrated in FIG. 7, the induction heater 40 is disposed outside the loop formed by the fixing belt 21, and heats the fixing belt 21 via the supporting member 22. Alternatively, the induction heater 40 may directly heat the fixing belt 21.

In such a configuration, the fixing belt 21 includes a conductive layer as an inner layer. When magnetic lines of force generated by the induction heater 40 pass over the conductive layer of the fixing belt 21, an eddy current is generated in the conductive layer that in turn generates a magnetic field that prevents change in an alternating magnetic field of the magnetic lines of force. The eddy current flowing in the conductive layer generates Joule heat proportional to the resistance of the conductive layer to heat the fixing belt 21.

The supporting member 22 contacts or faces the inner circumferential surface of the fixing belt 21 to support and heat the fixing belt 21. The supporting member 22 may be manufactured by bending a thin metal plate into a pipe shape at relatively reduced manufacturing costs, improving heating efficiency for heating the fixing belt 21, shortening a warm-up time or a first print time, and suppressing faulty fixing which may occur when the fixing device 20 is driven at high speed.

Figure 8:
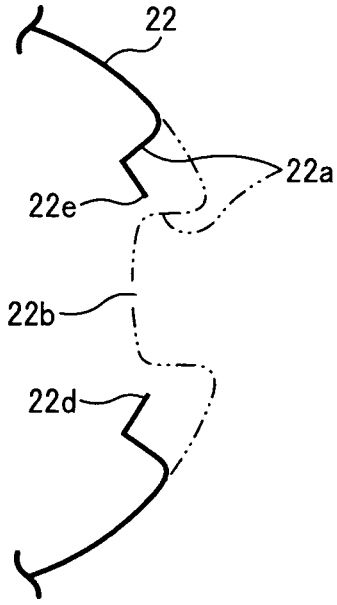
FIG. 8 is a partial enlarged view illustrating a supporting member illustrated in FIG. 3.

If the thin metal plate is bent into the pipe shape in such a manner that an upstream edge 22*d* of the supporting member 22 provided upstream from the fixing nip N in the rotation direction R2 of the fixing belt 21 is separated from a downstream edge 22*e* of the supporting member 22 provided downstream from the fixing nip N, the inherent spring-back property of the thin metal plate may enlarge the opening of a side edge portion 22*b* between the upstream edge 22*d* and the downstream edge 22*e* as illustrated in FIG. 8. Consequently, the supporting member 22 may not contact or press against the fixing belt 21 with uniform pressure thereacross.

Hence, at least a part of the upstream edge 22*d* in a width direction, that is, an axial direction, of the supporting member 22 may be connected with the downstream edge 22*e* to prevent the spring-back of the supporting member 22 from enlarging the opening of the side edge portion 22*b* between the upstream edge 22*d* and the downstream edge 22*e*. For example, the upstream edge 22*d* may be connected with the downstream edge 22*e* by welding the side edge portion 22*b*.

The supporting member 22 illustrated in FIG. 3 includes the recessed portion 22*a* to accommodate the nip formation member 26. If corner portions 22*c* and the vicinity thereof contact or press against the pressing roller 31 via the fixing belt 21, pressure applied by the pressing roller 31 may deform the supporting member 22. Consequently, the supporting member 22 may not contact or press against the fixing belt 21 with uniform pressure.

Hence, according to the above-described exemplary embodiments, the supporting member 22 including the corner portions 22*c* does not press against the pressing roller 31 via the fixing belt 21. For example, the corner portions 22*c* are provided at positions separated from the fixing nip N so that the corner portions 22*c* are separated from the pressing roller 31.

According to the above-described exemplary embodiments, in the fixing device 20, the pressing roller 31 is used as a pressing member. Alternatively, a pressing belt or a pressing pad may be used as a pressing member to provide effects equivalent to the above-described effects provided by the fixing device 20 including the pressing roller 31.

According to the above-described exemplary embodiments, the fixing belt 21 having a multi-layered structure is used as a fixing member. Alternatively, an endless fixing film including polyimide resin, polyamide resin, fluorocarbon resin, and/or thin metal may be used as a fixing member to provide effects equivalent to the above-described effects provided by the fixing device 20 including the fixing belt 21.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different exemplary embodiments may be combined with each other and/or substituted for each other within the scope of this disclosure and appended claims.

What is claimed is:

1. A fixing device comprising:

an endless, loop-shaped, flexible fixing member;

a supporting member having a pipe shape disposed inside a loop formed by the fixing member to support the fixing member;

a pressing member disposed opposite the supporting member via the fixing member; and a nip formation member disposed opposite the pressing member via the fixing member to form a fixing nip between the fixing member and the pressing member, the fixing member disposed to contact an outer circumferential face of the supporting member at a side opposite a side at which the fixing member contacts the nip formation member at the fixing nip, the fixing member driven in accordance with rotation of the pressing member to convey a recording medium to the fixing nip, the fixing member having slack portions formed upstream and downstream from the fixing nip in a conveyance direction in which the recording medium is conveyed, the slack portions extending toward the pressing member over the fixing nip without contacting either the supporting member or the pressing member.

2. The fixing device according to claim 1, wherein the nip formation member has a contact portion contacting the pressing member and the contact portion has a curvature matching a curvature of a cross section of the pressing member.

3. The fixing device according to claim 1, wherein the nip formation member has a curvature radius of approximately 25 mm to approximately 60 mm.

4. The fixing device according to claim 1, wherein the fixing member comprising a substrate made of stainless steel or nickel and the substrate has a thickness of approximately 25 μm to approximately 50 μm.

5. The fixing device according to claim 1, wherein a center of a curvature of the nip formation member is vertically positioned at substantially the same position as a center of the pressing member.

6. The fixing device according to claim 1, wherein the slack portions of the fixing member upstream and downstream from the fixing nip in the conveyance direction are formed in substantially same shapes.

7. The fixing device according to claim 1, further comprising a heater disposed inside the supporting member to heat the fixing member via the supporting member.

8. The fixing device according to claim 1, further comprising a heater disposed outside the loop formed by the fixing member to heat the fixing member via the supporting member.

9. The fixing device according to claim 1, further comprising a heater disposed outside the loop formed by the fixing member to directly heat an outer circumferential portion of the fixing member.

10. The fixing device according to claim 1, wherein the fixing member is an endless flexible belt.

11. The fixing device according to claim 1, wherein the pressing member is a pressing roller.

12. An image forming apparatus comprising:

an image forming device to form a toner image on a recording medium; and a fixing device to fix the toner image on the recording medium, the fixing device comprising:

an endless, loop-shaped, flexible fixing member;

a supporting member having a pipe shape disposed inside a loop formed by the fixing member to support the fixing member;

a pressing member disposed opposite the supporting member via the fixing member; and a nip formation member disposed opposite the pressing member via the fixing member to form a fixing nip between the fixing member and the pressing member, the fixing member disposed to contact an outer circumferential face of the supporting member at a side opposite a side at which the fixing member contacts the nip formation member at the fixing nip, the fixing member driven in accordance with rotation of the pressing member to convey the recording medium to the fixing nip, the fixing member having slack portions formed upstream and downstream from the fixing nip in a conveyance direction in which the recording medium is conveyed, the slack portions extending toward the pressing member over the fixing nip without contacting either the supporting member or the pressing member.

* * * * *